US010897086B2

(12) United States Patent
Tomlin

(10) Patent No.: US 10,897,086 B2
(45) Date of Patent: Jan. 19, 2021

(54) CONFIGURABLE ANTENNA

(71) Applicant: ANTENOVA LIMITED, Hatfield (GB)

(72) Inventor: Christopher Tomlin, Hatfield (GB)

(73) Assignee: ANTENOVA LIMITED, Hatfield (GB)

( * ) Notice: Subject to any disclaimer, the term of this patent is extended or adjusted under 35 U.S.C. 154(b) by 381 days.

(21) Appl. No.: 16/067,198

(22) PCT Filed: Dec. 30, 2016

(86) PCT No.: PCT/GB2016/054088
§ 371 (c)(1),
(2) Date: Jun. 29, 2018

(87) PCT Pub. No.: WO2017/115089
PCT Pub. Date: Jul. 6, 2017

(65) Prior Publication Data

US 2019/0027829 A1 Jan. 24, 2019

(30) Foreign Application Priority Data

Dec. 30, 2015 (GB) ..... 1523090.7

(51) Int. Cl.
*H01Q 9/04* (2006.01)
*H01Q 3/24* (2006.01)
(Continued)

(52) U.S. Cl.
CPC ..... *H01Q 9/0421* (2013.01); *H01Q 3/24* (2013.01); *H01Q 5/364* (2015.01); *H01Q 5/378* (2015.01);
(Continued)

(58) Field of Classification Search
CPC ..... H01Q 5/364; H01Q 1/38; H01Q 7/00; H01Q 9/0421; H01Q 5/378; H01Q 3/24; H01Q 9/42; H01Q 3/01; H01Q 9/045
See application file for complete search history.

(56) References Cited

U.S. PATENT DOCUMENTS 6,204,819 B1 3/2001 Hayes
6,348,897 B1 2/2002 Alameh et al.
(Continued)

FOREIGN PATENT DOCUMENTS

WO 2006034940 A1 4/2006
WO 2011072844 A1 6/2011

*Primary Examiner* — Graham P Smith
*Assistant Examiner* — Jae K Kim
(74) *Attorney, Agent, or Firm* — E. Eric Mills; Nexsen Pruet, PLLC

(57) ABSTRACT

There is disclosed an antenna device comprising at least first and second electrically conductive tracks disposed in at least first and second planes in a laminate dielectric structure. Each electrically conductive track has at least two electrical connection points on an external surface of the laminate dielectric structure. The antenna device is reconfigurable between a plurality of different antenna types by connecting the electrical connection points to external circuitry in different configurations. In this way, a single antenna device may be configured as two or more of: a dielectric antenna, a planar inverted-F antenna (PIFA), a planar inverted-L antenna (PILA), a loop antenna, a monopole antenna and a capacitively-fed antenna.

15 Claims, 4 Drawing Sheets

(51) Int. Cl.

| | |
|---|---|
| ***H01Q 7/00*** | (2006.01) |
| ***H01Q 9/42*** | (2006.01) |
| ***H01Q 5/378*** | (2015.01) |
| ***H01Q 5/364*** | (2015.01) |

(52) U.S. Cl.
CPC ..... *H01Q 7/00* (2013.01); *H01Q 9/045* (2013.01); *H01Q 9/42* (2013.01)

(56) References Cited

U.S. PATENT DOCUMENTS 6,662,028 B1 12/2003 Hayes et al.
7,183,976 B2 * 2/2007 Wu ..... H01Q 1/36 343/700 MS
7,626,555 B2 * 12/2009 Kalliokoski ..... H01Q 9/0471 343/702
8,836,594 B2 * 9/2014 Rothwell ..... H01Q 3/247 343/731
8,854,273 B2 * 10/2014 Li ..... H01Q 21/28 343/803
9,660,340 B2 * 5/2017 Yokoyama ..... H01Q 5/35
2004/0227608 A1 * 11/2004 Nakatani ..... H01P 5/10 336/173
2008/0062049 A1 3/2008 Castany et al.
2009/0027278 A1 1/2009 Soora et al.
2009/0251383 A1 10/2009 Tani et al.
2010/0245201 A1 * 9/2010 Hossain ..... H01Q 1/243 343/848
2011/0050532 A1 3/2011 Liu
2011/0095948 A1 * 4/2011 Alexopoulos ..... H01Q 1/38 343/700 MS
2011/0275333 A1 11/2011 Kim et al.
2011/0298669 A1 * 12/2011 Rao ..... H01Q 9/42 343/702
2012/0112968 A1 5/2012 Collins et al.
2015/0188228 A1 * 7/2015 Yosui ..... H01Q 1/243 343/788
2015/0303570 A1 * 10/2015 Harper ..... H01Q 1/243 343/870
2017/0117081 A1 * 4/2017 Chatani ..... C22C 38/18
2017/0149146 A1 * 5/2017 Montgomery ..... H01Q 21/205
2017/0194717 A1 * 7/2017 Kosaka ..... H01Q 9/0435

* cited by examiner

CONFIGURABLE ANTENNA

CROSS REFERENCE TO RELATED APPLICATIONS

This application is a 35 U.S.C. § 371 U.S. national phase entry of International Application No. PCT/GB2016/054088 having an international filing date of Dec. 30, 2016, which claims the benefit of Great Britain Application No. 1523090.7 filed Dec. 30, 2015, each of which is incorporated herein by reference in its entirety.

This invention relates to an antenna device that is reconfigurable as various different types of antenna depending on how it is connected to a transmitter or receiver. Certain embodiments provide a single hardware solution configurable to multiple different hardware properties allowing the fixed hardware product to operate in any required band or frequency range or even as a multiband antenna. This may be achieved by user configurable pins. In some embodiments, it is possible dynamically to change the type of antenna structure.

BACKGROUND

With the rapid expansion of the market for telecommunications devices, especially in the machine-to-machine (M2M) or "Internet of Things" sector, and the development of different communications protocols, including WiFi, 4G, LTE etc., many devices require multiple internal antennas covering a wide range of user frequencies. This means that design-in times are extended and RF problems increased. The situation is further complicated by the need for each antenna to be of a different design, with each antenna having its own specific environment needs within the hardware. It would be desirable to have a single form factor antenna solution that can adapt to any required band or bands, since this would mean simpler hardware development to streamline the design cycle.

Moreover, as these devices become more complex, this has the consequence that the antennas require greater operational flexibility to accommodate the device. It would also be desirable to have an antenna device with a single form factor that can change its functionality in a dynamic manner. In particular, it would be desirable to have a drop-in solution that can be simply changed on the schematic to behave like a completely different antenna.

BRIEF SUMMARY OF THE DISCLOSURE

Viewed from a first aspect, there is provided an antenna device comprising at least first and second electrically conductive tracks disposed in at least first and second planes in a laminate dielectric structure, each electrically conductive track having at least two electrical connection points on an external surface of the laminate dielectric structure, wherein the antenna device is reconfigurable between a plurality of different antenna types by connecting the electrical connection points to external circuitry in different configurations.

The first and/or the second tracks preferably have meandering configurations. The meandering configurations are carefully designed so that the first and/or the second tracks have predetermined inductances and optional internal capacitances. The meander allows the length of each track to be controlled, and also primarily serves to control the inductance of the respective track.

Advantageously, portions of the first track in the first plane overlap portions of the second track in the second plane, with the overlapping portions allowing capacitive interactions between the first and second tracks.

The at least first and second planes may be substantially parallel to each other, with a layer of dielectric material separating the at least first and second planes.

Each of the at least first and second tracks may have first and second ends, with an electrical connection point at each of the respective first and second ends.

In some embodiments, one or other or both of the at least first and second tracks may be disposed in both the first and the second planes, crossing from one plane to another by way of vias or other electrical connections between the planes.

In some embodiments, the electrical connection points are configured as pins extending from the laminate dielectric structure. Alternatively, the electrical connection points may be configured as surface mount pads, in which case it is preferable for all of the pads to be formed on one surface (for example an underside) of the laminate dielectric structure. The antenna device may be connected to external circuitry by way of a PCB provided with connections for the pins or surface mount pads corresponding to the surface mount pads on the antenna device.

The laminate dielectric structure preferably has a cuboid shape or form factor. Advantageously, where the electrical connection pads are all provided on one surface of the laminate dielectric structure, this surface is substantially square. For example, four surface mount pads may be provided in respective corners or at mid-points of respective edges of a square surface. This means that up to four different connection schemas may be implemented simply by mounting the laminate dielectric structure in any of four different 90° rotations about an axis passing perpendicularly through the centre of the square surface. Additional connection schemas may be implemented by reconfiguring the corresponding connections on the PCB on which the antenna device is mounted. Dynamic reconfiguration of the antenna device may be effected by way of an RF switch which may, for example, be provided on the PCB. The RF switch may be operated so as to change the connection schema, for example by changing the ways in which the electrical connection points of the antenna device are connected to RF ground or to an RF feed.

Certain embodiments make use of a multilayer configurable antenna structure within a laminate. The antenna structure may be such that it can be made to display a multitude of electrical properties with either a one-time setup or electronic dynamic control. In some embodiments, the antenna structure can be configured or controlled to switch between radiating elements of varying types without host PCB modifications. The radiating element can take different forms. For example, a single antenna device may be configured to operate in one or more of the following modes: dielectric antenna (including dielectric resonator antenna and/or dielectrically-loaded antenna), PIFA, PILA, loop, monopole, and/or capacitive-fed. By providing one or more RF switches in combination with the antenna device, it is possible dynamically to reconfigure the electrical connections on the host PCB so as to allow a single antenna device to be dynamically switched between two or more of the following modes: dielectric antenna (including dielectric resonator antenna and/or dielectrically-loaded antenna), PIFA, PILA, loop, monopole, and/or capacitive-fed. In some embodiments, the antenna device may be configured as an RF coupler. The RF properties of the structure include complex interactions involving inductive coupling, capacitive coupling and coupling to its own internal structure. These properties are dependent on the setup and configuration used.

BRIEF DESCRIPTION OF THE DRAWINGS

Embodiments of the invention are further described hereinafter with reference to the accompanying drawings, in which.

DETAILED DESCRIPTION

Figure 1:
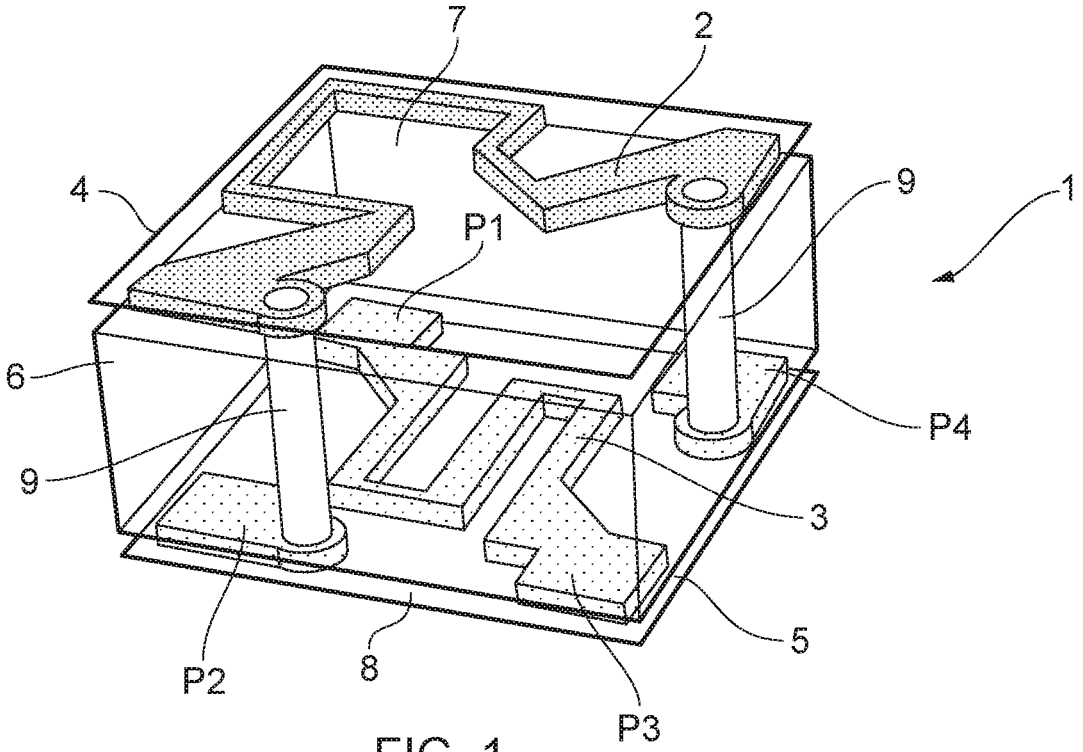
FIGS. 1 and 2 are schematic views of a first embodiment.
Figure 2:
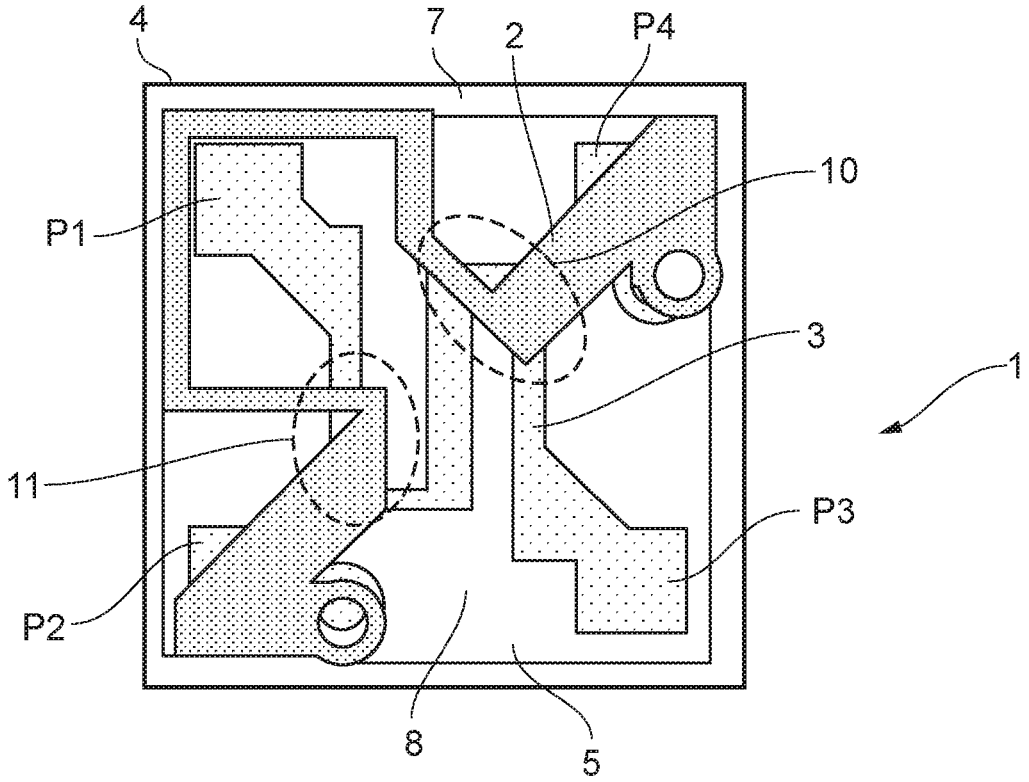

FIGS. 1 and 2 show an exemplary embodiment of an antenna device 1 comprising first and second electrically conductive tracks 2, 3 disposed in first and second planes 4, 5 in a laminate dielectric structure. The first and second planes 4, 5 are separated by a layer of dielectric material 6. Additional layers 7, 8 of the same or different dielectric materials are provided on the top and bottom of the antenna device 1 so as to protect the electrically conductive tracks 2, 3. The ends of the first electrically conductive track 2 in the first plane 4 are provided with vias 9 to allow electrical connection to conductive surface mount pads P2 and P4. The ends of the second electrically conductive track 3 are provided with conductive surface mount pads P1 and P3. The surface mount pads P1 to P4 are exposed on the underside of the antenna device 1, and in the example shown, are disposed in the corners of a square underside. The first and second conductive tracks 2, 3 each have a meandering structure configured to provide predetermined inductances. In addition, the first and second conductive tracks 2, 3 have regions of mutual overlap 10, 11 as shown best in FIG. 2. The regions of mutual overlap 10, 11 give predetermined capacitive properties.

Figure 3:
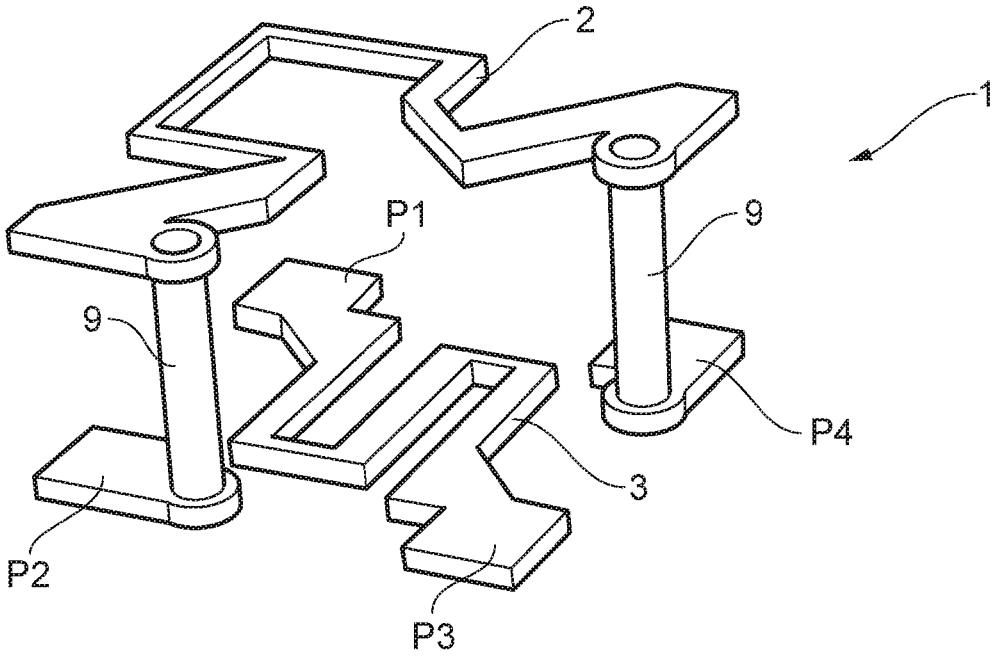
FIGS. 3 and 4 are schematic views of electrically conductive components of the embodiment of FIGS. 1 and 2.
Figure 4:
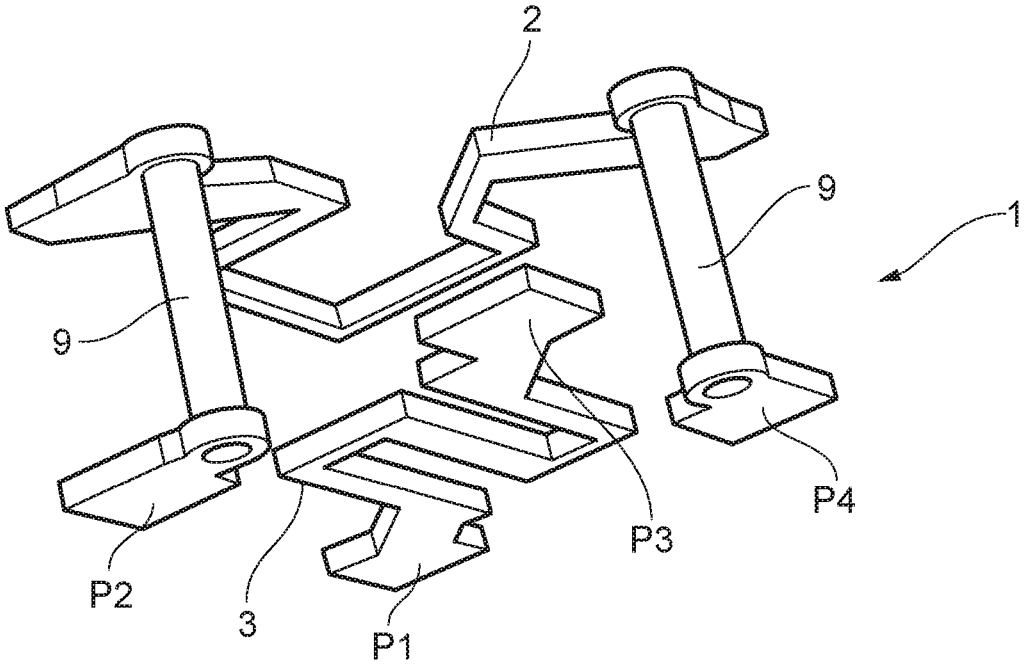

FIGS. 3 and 4 show exploded views of the electrically conductive components of the antenna device 1, with the dielectric components omitted for clarity. The precise shape, configuration and path taken by each of the electrically conductive tracks 2, 3 depends on the particular antenna properties that are desired.

Figure 5:
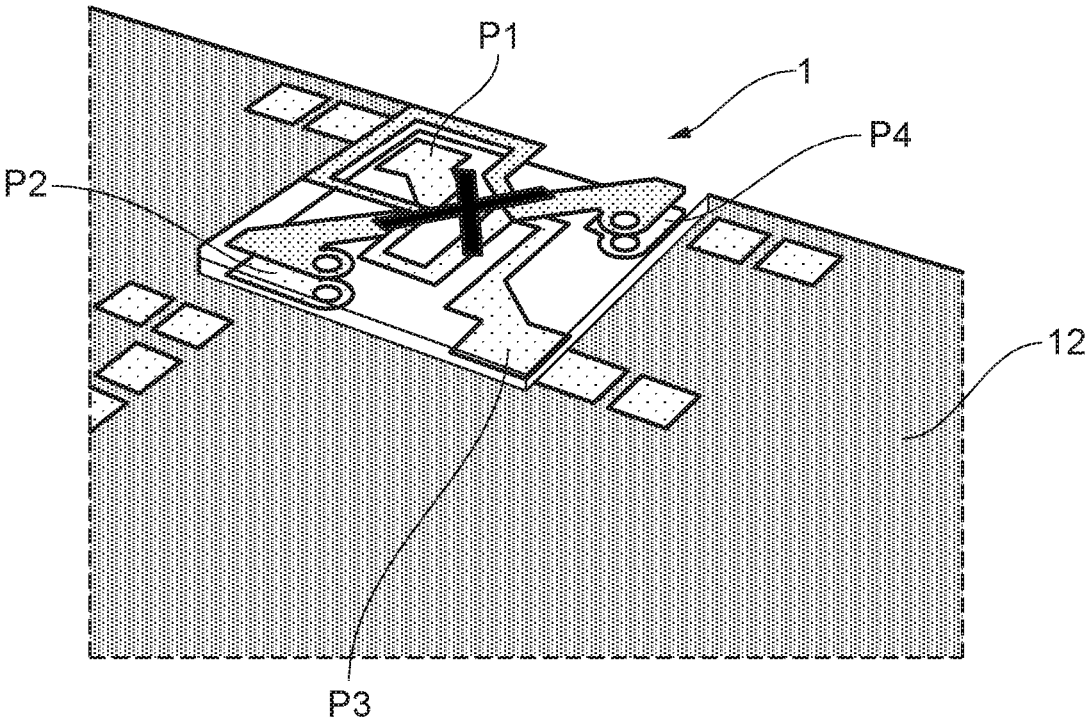
FIG. 5 shows an embodiment mounted on a printed circuit board.

FIG. 5 shows the antenna device 1 mounted on a PCB 12 using surface mount technology. Surface mount pads P1, P3 and P4 are connected to ground by way of corresponding surface mount pads on the PCB 12. Surface mount pad P2 is connected to an RF feed by way of a corresponding surface mount pad on the PCB 12.

Figure 6:
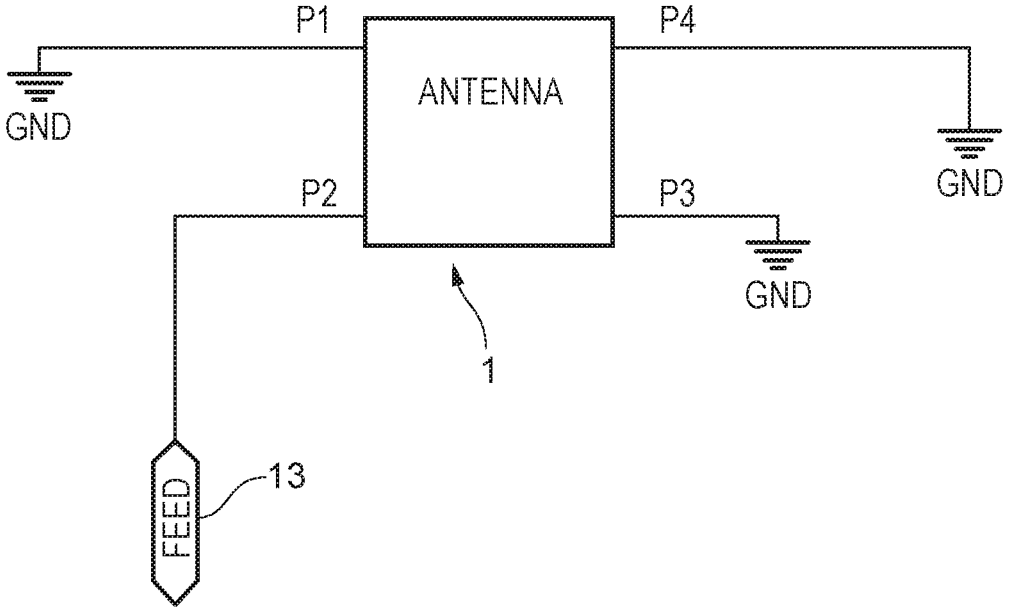
FIG. 6 shows a first connection arrangement.

FIG. 6 shows a schematic representation of the arrangement of FIG. 5, with the RF feed indicated at 13. In this configuration, the antenna device 1 can operate in a dielectric resonator mode, with connection P2 being connected to the RF feed 13, and connections P1, P3 and P4 connected to RF ground. This configuration may be useful for dual band WiFi operation (e.g. at 2.4 GHz and 5 GHz).

Figure 7:
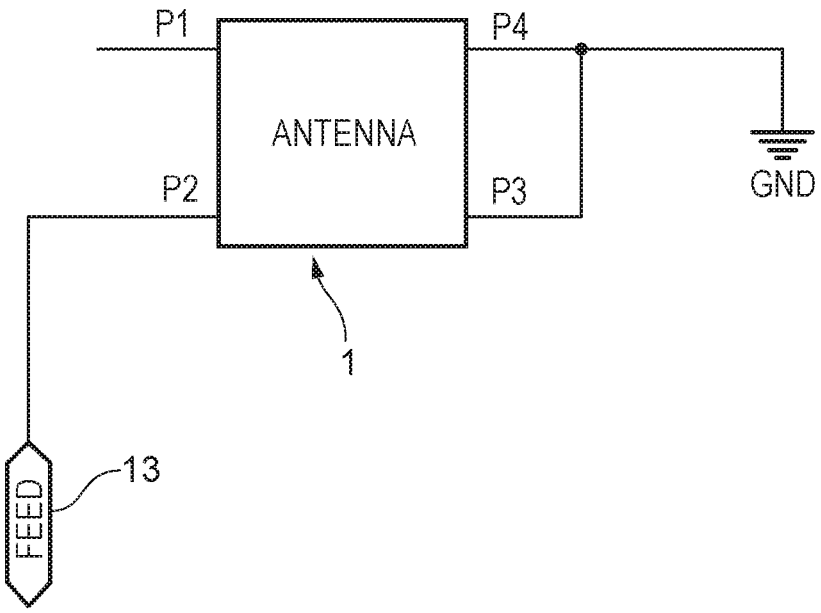
FIG. 7 shows a second connection arrangement.

FIG. 7 shows a schematic outline of an alternative configuration, with connection P2 connected to the RF feed 13, connections P3 and P4 connected together and to RF ground, and connection P1 left unterminated (open circuit). It will be noted that P1 is connected internally to P3. In this configuration, the antenna device 1 operates as a PIFA.

Figure 8:
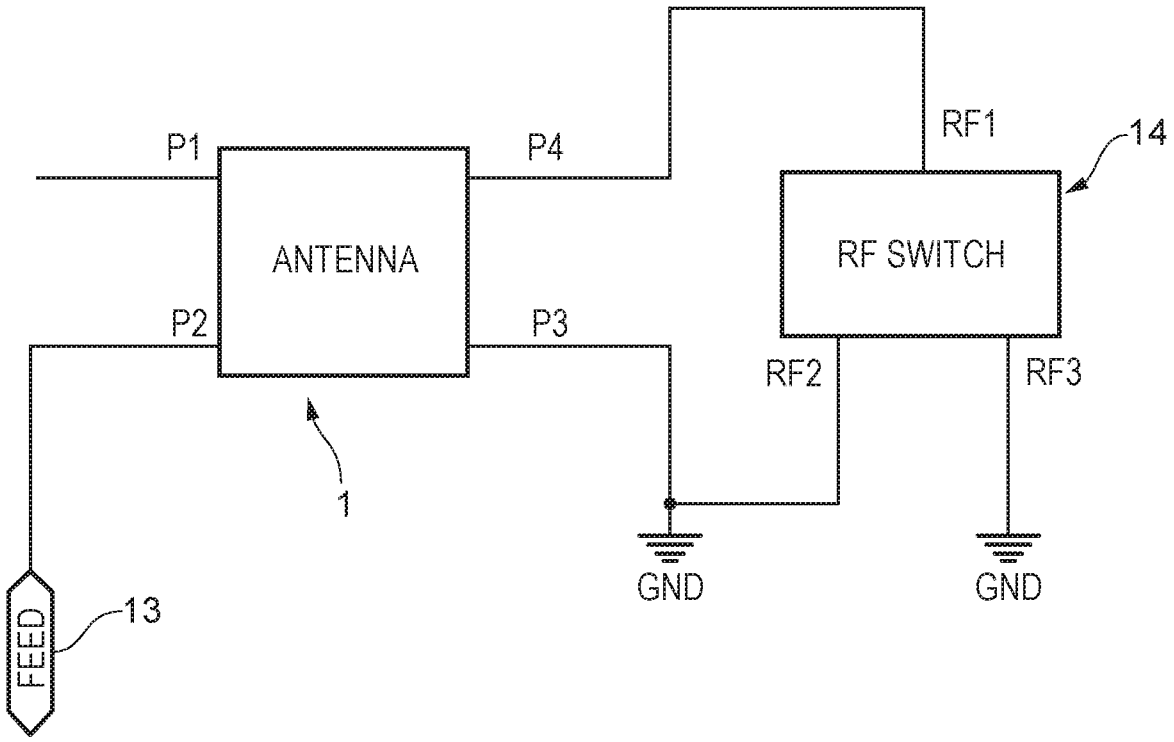
FIG. 8 shows a third connection arrangement including an RF switch.

FIG. 8 shows a schematic outline of an alternative configuration, with connection P2 connected to the RF feed 13, connection P1 left unterminated (open circuit), and connection P3 is connected to RF ground. Connection P4 is connected at RF1 to an RF switch 14, which is switchable so as to connect connection P4 either directly to RF ground via connection RF3, or to RF ground together with connection P3 via connection RF2. In this way, the antenna device 1 can be switched dynamically between PIFA mode and dielectric resonator mode by switching RF switch 14 between RF2 and RF3.

The structure of the antenna device 1 is configured such that it exhibits both capacitive and inductive properties. Configuring the antenna device 1 so that it has both capacitive and inductive properties enables the antenna device 1 to change states depending on the arrangement of the pins or surface mount pads. A single antenna device 1 can therefore be used in situations where a capacitive arrangement is required or where an inductive arrangement is required.

The internal structure of the antenna device defines the inductive and capacitive properties. For example, in a capacitive configuration, the capacitance is defined internally between the top and bottom layer traces. In an inductive configuration, the inductive properties are defined as a result of the length of each trace within the antenna. Two separate lines exist within the antenna and each have difference inductive values. It is this difference which enables the different capacitive and inductive configurations. Both these properties change depending on the pin configurations.

A benefit of this is that the manufacturing or electronic devices requiring antenna devices can be simplified by only requiring a single type of antenna device and costs can therefore be reduced. The structure is such that the electrical length between two paths are not the same to provide multiple inductive values, while the capacitive value fixed or removed completely by the pin arrangement.

It will be apparent that other configurations may be employed to make the antenna device operate as different types of antenna. For example, by connecting the RF feed 13 to P2 and leaving the other connections P1, P3 and P4 unterminated, a monopole antenna is realised. Alternatively, connections P2 and P4 could be connected to a balanced feed, with connections P1 and P3 unterminated, so as to realise a loop antenna. Other configurations can be implemented to realise a capacitive fed antenna or a PILA. One or more RF switches 14 can be provided to allow dynamic switching between the various antenna configurations.

A particular advantage of certain embodiments of the present disclosure is that a single antenna device 1 can be used in several different ways, to cover different frequency bands, both passively and actively. This reduces the need to have many different types of antenna on hand when tailoring devices for different applications.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An antenna device comprising at least first and second electrically conductive tracks disposed in at least first and second planes in a laminate dielectric structure, each electrically conductive track having at least two electrical connection points on an external surface of the laminate dielectric structure, wherein the antenna device is reconfigurable between a plurality of different antenna types by connecting the electrical connection points to external circuitry in different configurations.

2. The antenna device of claim 1, wherein the first and/or the second tracks have meandering configurations.

3. The antenna device of claim 1, wherein portions of the first track in the first plane overlap portions of the second track in the second plane, with the overlapping portions allowing capacitive interactions between the first and second tracks.

4. The antenna device of claim 1, wherein the at least first and second planes are substantially parallel to each other, with a layer of dielectric material separating the at least first and second planes.

5. The antenna device of claim 1, wherein each of the at least first and second tracks has first and second ends, with an electrical connection point at each of the respective first and second ends.

6. The antenna device of claim 1, wherein one or other or both of the at least first and second tracks is or are disposed in both the first and the second planes, crossing from one plane to another by way of vias or other electrical connections between the planes.

7. The antenna device of claim 1, wherein the electrical connection points are configured as pins extending from the laminate dielectric structure.

8. The antenna device of claim 1, wherein the electrical connection points are configured as surface mount pads.

9. The antenna device of claim 8, wherein all of the surface mount pads are formed on one surface of the laminate dielectric structure.

10. The antenna device of claim 9, wherein the surface is a square surface.

11. The antenna device of claim 10, wherein four surface mount pads are disposed on the square surface, one in each corner of the square surface or one at the midpoint of each side of the square surface.

12. The antenna device of claim 1, wherein the laminate dielectric structure has a cuboid shape or form factor.

13. The antenna device of claim 1, selectively configurable as at least two of: a dielectric antenna, a planar inverted-F antenna (PIFA), a planar inverted-L antenna (PILA), a loop antenna, a monopole antenna and a capacitively-fed antenna by changing the connections to the electrical connection points.

14. The antenna device of claim 13, in combination with an RF switch to allow dynamic reconfiguration of the antenna device by dynamically changing the connections to the electrical connection points.

15. The antenna device according to claim 1, wherein the at least first and second electrically conductive tracks are configured such that the antenna device 1 exhibits both capacitive and inductive properties.

* * * * *